US009102484B2

(12) United States Patent
Arimura

(10) Patent No.: US 9,102,484 B2
(45) Date of Patent: Aug. 11, 2015

(54) RECORDING MEDIUM FEEDING UNIT AND IMAGE FORMING APPARATUS INCLUDING THE SAME

(71) Applicant: KYOCERA Document Solutions Inc., Osaka (JP)

(72) Inventor: Shingo Arimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 11 days.

(21) Appl. No.: 14/229,086

(22) Filed: Mar. 28, 2014

(65) Prior Publication Data

US 2014/0291919 A1 Oct. 2, 2014

(30) Foreign Application Priority Data

Mar. 29, 2013 (JP) ..... 2013-072055

(51) Int. Cl.
*B65H 31/20* (2006.01)
*B65H 1/04* (2006.01)

(52) U.S. Cl.
CPC ..... *B65H 1/04* (2013.01); *B65H 2405/1144* (2013.01); *B65H 2511/12* (2013.01)

(58) Field of Classification Search
CPC .... B65H 31/20; B65H 2701/113; B65H 1/04; B65H 2402/514; B65H 2402/516; B65H 2405/111; B65H 2405/1144; B65H 2405/11425; B65H 2511/11; B65H 2511/12
USPC ..... 271/171, 223
See application file for complete search history.

(56) References Cited

FOREIGN PATENT DOCUMENTS

JP 06329272 A * 11/1994 ..... B65H 1/04
JP H11-263449 A 9/1999

OTHER PUBLICATIONS

Machine translation of JP 06329272 A, retrieved Aug. 16, 2014.*

* cited by examiner

*Primary Examiner* — Michael McCullough
(74) *Attorney, Agent, or Firm* — Studebaker & Brackett PC

(57) ABSTRACT

A recording medium feeding unit includes a recording medium loading plate, a main body, positioning members, racks, a pinion, a rotating shaft and an adjustment member. The main body holds the recording medium loading plate. The positioning members position the recording member in a widthwise direction. The racks are respectively provided on the positioning members, extend along the widthwise direction, and move in the widthwise direction integrally with the positioning members. The pinion is rotatably provided on the main body, is engaged with each of the racks, and is rotated in association with the movement of the racks. The rotating shaft rotatably supports the pinion. The adjustment member applies a rotation load to the pinion by allowing the pinion to be in contact therewith. The adjustment member is capable of adjusting the rotation load in a manner to move in the thickness direction of the recording medium loading plate.

14 Claims, 9 Drawing Sheets

RECORDING MEDIUM FEEDING UNIT AND IMAGE FORMING APPARATUS INCLUDING THE SAME

INCORPORATION BY REFERENCE

The present application claims priority under 35 U.S.C. §119 to Japanese Patent Application No. 2013-072055, filed on Mar. 29, 2013. The contents of this application are incorporated herein by reference in their entirety.

BACKGROUND

The present disclosure relates to a recording medium feeding unit including a recording medium loading plate on which a sheet-like recording medium is loaded and positioning members that position the recording medium in the widthwise direction, and an image forming apparatus including the same.

Recording medium feeding units such as a stack tray (also designated as a manual feed tray) and a paper feed cassette are widely used. A recording medium feeding unit holds a pile of a plurality of sheet-like paper (recording media) for separating and feeding the paper one by one to an image forming section provided in the main body of an image forming apparatus in accordance with an image forming operation.

The configuration of a general stack tray will be described. FIGS. 7 to 9 are perspective views illustrating an example of a general stack tray. As illustrated in FIG. 7, the general stack tray 135 includes a paper loading plate 150, a pair of widthwise positioning members 151, a main body 152, a pair of racks 153 (see FIG. 8) and a pinion 154 (see FIG. 8).

Paper is loaded on the paper loading plate 150. The main body 152 holds the paper loading plate 150. The pair of widthwise positioning members 151 position the paper in the widthwise direction perpendicular to a paper feeding direction. Each of the pair of racks 153 extends along the widthwise direction perpendicular to the paper feeding direction (that is, a paper conveyance direction or a direction illustrated with an arrow A). The pair of racks 153 are configured to move in the widthwise direction integrally with the widthwise positioning members 151. The pinion 154 is engaged with the pair of racks 153. The pinion 154 has, on its outer circumferential surface, a pinion gear (not shown) engaged with a rack gear 153*a* of each rack 153. Accordingly, the pinion 154 is rotated in association with the movement of the racks 153. As a result, when one of the widthwise positioning members 151 is moved, the pinion 154 is rotated, so as to move the other of the widthwise positioning members 151 in the opposite direction to the former widthwise positioning member 151 by the same distance.

If the pinion 154 has such a small rotation load that the widthwise positioning members 151 can be easily moved in the widthwise direction, paper is skewed (inclined) in feeding. In particular, the skew is easily caused in feeding thick paper. Therefore, in order to cope with the feed of thick paper, the rotation load of the pinion 154 is set to be large, in the stack tray 135, for restraining the movement of the widthwise positioning members 151.

Specifically, as illustrated in FIG. 9, a boss 150*a* serving as the rotating shaft of the pinion 154 is formed on the rear surface of the paper loading plate 150. The boss 150*a* is provided with a rib 150*b* for increasing a contact area with the pinion 154. As a result, the rotation load of the pinion 154 is increased so as to restrain the movement of the widthwise positioning members 151.

Incidentally, in some paper feeding device, a paper loading section (corresponding to a paper loading plate) is elevated to secure a side fence (corresponding to the widthwise positioning member).

SUMMARY

A recording medium feeding unit according to one aspect of the present disclosure includes a recording medium loading plate, a main body, a pair of positioning members, a pair of racks, a pinion, a rotating shaft and an adjustment member. A recording medium is loaded on the recording medium loading plate. The main body holds the recording medium loading plate. The pair of positioning members position the recording medium in a widthwise direction perpendicular to a conveyance direction for the recording medium. The pair of racks are respectively provided on the pair of positioning members, extend along the widthwise direction and move in the widthwise direction integrally with the pair of positioning members. The pinion is rotatably provided on the main body, is engaged with each of the racks, and is rotated in association with the movement of the racks. The rotating shaft protrudes on the recording medium loading plate and is rotatably support the pinion. The adjustment member adjusts a rotation load of the pinion by allowing the pinion to be in contact therewith. The adjusting member is capable of adjusting the rotation load of the pinion in a manner to move in a thickness direction of the recording medium loading plate.

An image forming apparatus according to another aspect of the present disclosure includes the recording medium feeding unit of the aforementioned aspect and an image forming section. The image forming section forms an image on a recording medium fed from the recording medium feeding unit.

DETAILED DESCRIPTION

Figure 1:
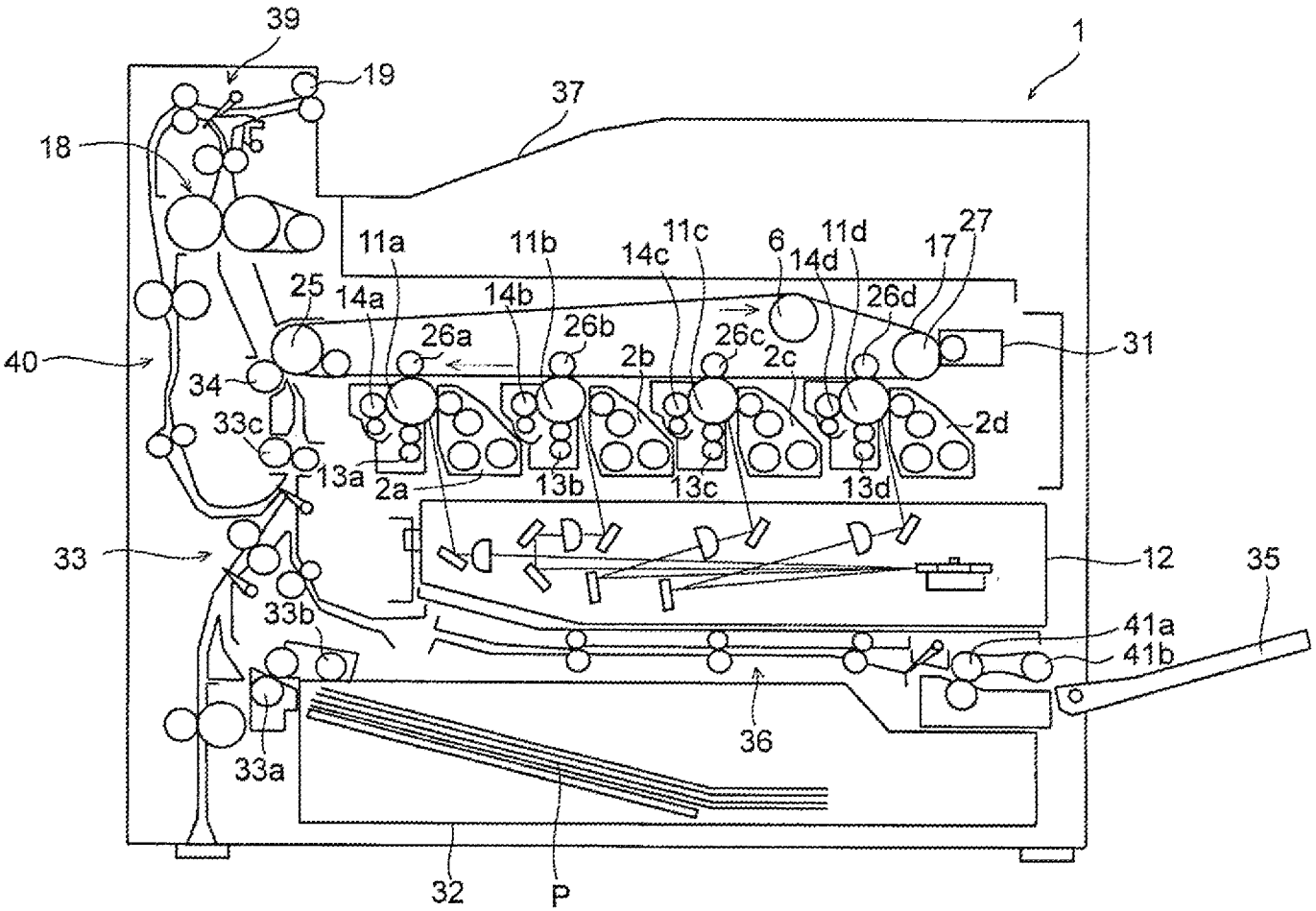
FIG. 1 is a cross-sectional view schematically illustrating the configuration of an image forming apparatus including a stack tray according to one embodiment of the present disclosure.

Now, one embodiment of the present disclosure will be described with reference to the accompanying drawings. It is noted that like reference numerals are used to refer to like or corresponding elements in these drawings to avoid redundant description.

Referring to FIGS. 1 to 6, the configuration of an image forming apparatus 1 including a stack tray (corresponding to a recording medium feeding unit) 35 according to an embodiment of the present disclosure will be described. The image forming apparatus 1 of the present embodiment is a tandem color printer.

The image forming apparatus 1 includes an image forming section for forming an image on paper (corresponding to a recording medium) P fed from the stack tray 35. The image forming section includes photoconductive drums 11*a* to 11*d*, developing units 2*a* to 2*d*, an exposing unit 12, chargers 13*a* to 13*d*, cleaners 14*a* to 14*d*, primary transfer rollers 26*a* to 26*d*, an intermediate transfer belt 17 and a secondary transfer roller 34.

The photoconductive drums 11*a*, 11*b*, 11*c* and 11*d* are provided respectively correspondingly to colors of magenta, cyan, yellow and black. The developing units 2*a* to 2*d*, the exposing unit 12, the chargers 13*a* to 13*d* and the cleaners 14*a* to 14*d* are provided around and near the photoconductive drums 11*a* to 11*d*. Electrostatic latent images in accordance with image data are formed on the photoconductive drums 11*a* to 11*d* by the exposing unit 12 and the chargers 13*a* to 13*d*. The electrostatic latent images formed on the photoconductive drums 11*a* to 11*d* are developed into toner images respectively by the developing units 2*a* to 2*d*.

The endless intermediate transfer belt 17 is stretched around a tension roller 6, a drive roller 25 and a driven roller 27. The drive roller 25 is driven and rotated by a motor not shown. The intermediate transfer belt 17 is driven and rotated by the rotation of the drive roller 25.

The photoconductive drums 11*a* to 11*d* are provided below the intermediate transfer belt 17 to be in contact with the intermediate transfer belt 17 and to be adjacent to each other in a conveyance direction (illustrated with an arrow in FIG. 1) for the paper P. The primary transfer rollers 26*a* to 26*d* respectively oppose the photoconductive drums 11*a* to 11*d* with the intermediate transfer belt 17 sandwiched therebetween.

The primary transfer rollers 26*a* to 26*d* are in contact with the intermediate transfer belt 17 with a pressure to form primary transfer portions. In the primary transfer portions, the toner images respectively formed on the photoconductive drums 11*a* to 11*d* are successively transferred onto the intermediate transfer belt 17 at prescribed timing in association with the rotation of the intermediate transfer belt 17. As a result, a full color toner image is formed on the surface of the intermediate transfer belt 17 by overlapping the toner images of the four colors of magenta, cyan, yellow and black.

The secondary transfer roller 34 opposes the drive roller 25 with the intermediate transfer belt 17 sandwiched therebetween and is in contact with the intermediate transfer belt 17 with a pressure, thereby forming a secondary transfer portion. In the secondary transfer portion, the full color toner image formed on the surface of the intermediate transfer belt 17 is transferred to the paper P. After the transfer, a belt cleaning device 31 cleans the toner remaining on the intermediate transfer belt 17.

A paper feed cassette 32 for containing paper P is provided in a lower portion of the image forming apparatus 1. The stack tray 35 for supplying manually fed paper P is provided on the right hand side of the paper feed cassette 32. A first paper conveyance path 33 is provided on the left hand side of the paper feed cassette 32. The first paper conveyance path 33 conveys the paper P sent out from the paper feed cassette 32 to the secondary transfer portion of the intermediate transfer belt 17. Besides, a second paper conveyance path 36 is provided on the left hand side of the stack tray 35. The second paper conveyance path 36 conveys the paper P sent out from the stack tray 35 to the secondary transfer portion. Furthermore, a fixing section 18 and a third paper conveyance path 39 are provided in an upper left portion of the image forming apparatus 1. The fixing section 18 performs fixing processing on the paper P having an image formed thereon. The third paper conveyance path 39 conveys the paper P having been subjected to the fixing processing to a paper exit section 37.

The paper feed cassette 32 can be drawn outside (toward the surface side of FIG. 1) of the main body of the image forming apparatus 1 so that paper P can be replenished. The paper P held in the paper feed cassette 32 is sent out by a pickup roller 33*b* and a paper feed roller pair 33*a* one by one to the first paper conveyance path 33. The stack tray 35 is attached to the main body of the image forming apparatus 1. The paper P loaded on the stack tray 35 is sent out by a pickup roller 41*b* and a paper feed roller pair 41*a* one by one to the second paper conveyance path 36.

The first paper conveyance path 33 and the second paper conveyance path 36 meet before a registration roller pair 33*c*. The registration roller pair 33*c* conveys the paper P to the secondary transfer portion with timing of an image forming operation performed on the intermediate transfer belt 17 and a paper feeding operation. The full color toner image formed on the intermediate transfer belt 17 is secondarily transferred to the paper P, having been conveyed to the secondary transfer portion, by the secondary transfer roller 34 to which a bias potential is applied. In other words, the secondary transfer roller 34 transfers the image to the paper P having been fed from the paper feed cassette 32 or the stack tray 35. After the secondary transfer, the paper P is conveyed to the fixing section 18.

The fixing section 18 performs the fixing processing by heating and pressing the paper P to which the toner image has been transferred. Specifically, the fixing section 18 includes a fixing belt, a fixing roller, a pressure roller and the like. The fixing belt is heated by a heater. The fixing roller is in contact with the inner surface of the fixing belt. The pressure roller is provided to be in contact with the fixing roller with a pressure with the fixing belt sandwiched therebetween. After the fixing processing for the toner image performed by the fixing section 18, the paper P is turned over in a fourth paper conveyance path 40 if necessary. Then, a toner image is secondarily transferred by the secondary transfer roller 34 also on the rear surface of the paper P and then is fixed by the fixing section 18. The paper P having the toner image fixed thereon passes through the third paper conveyance path 39 to be exited to the paper exit section 37 by an exit roller pair 19.

Figure 2:
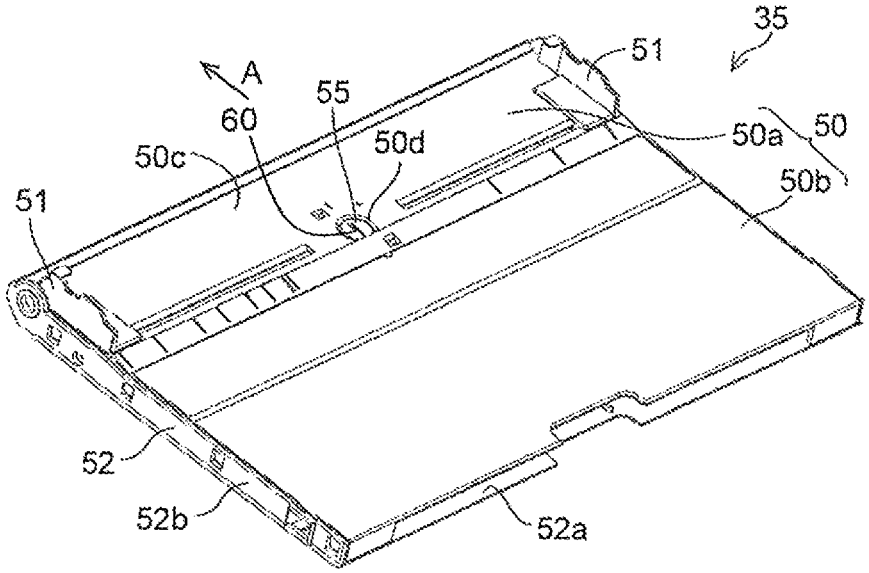
FIG. 2 is a perspective view illustrating the configuration of the stack tray of the embodiment.

Next, the configuration of the stack tray 35 will be described. In FIG. 2, a paper feeding direction (that is, a paper conveyance direction or a recording medium conveyance direction) in the stack tray 35 is indicated by an arrow A.

Figure 3:
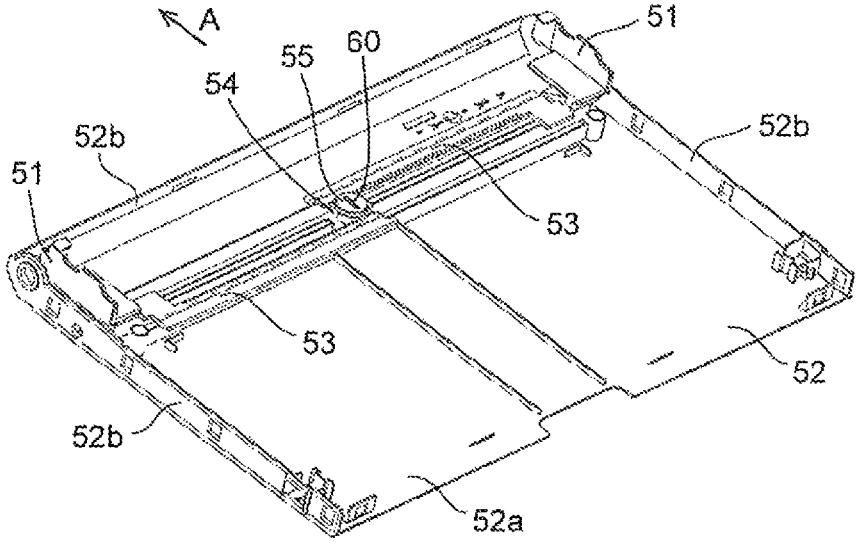
FIG. 3 is a perspective view illustrating the configuration of the stack tray of the embodiment from which a paper loading plate is removed.

As illustrated in FIGS. 2 and 3, the stack tray 35 includes a paper loading plate (corresponding to a recording medium loading plate) 50, a pair of widthwise positioning members (a pair of positioning members) 51, a main body 52, a pair of racks 53, a pinion 54 and an adjustment pin (adjustment member) 55.

Paper P is loaded on the paper loading plate 50. The main body 52 holds the paper loading plate 50. The main body 52 includes a bottom plate 52*a* and a plurality of walls 52*b* standing in a peripheral portion of the bottom plate 52*a*. The main body 52 houses the racks 53 and the pinion 54. The paper loading plate 50 is attached to the main body 52 so as to cover the racks 53 and the pinion 54. The paper loading plate 50 includes a downstream loading plate 50*a* and an upstream loading plate 50*b*. The downstream loading plate 50*a* is provided downstream in the paper feeding direction. The upstream loading plate 50*b* is provided upstream in the paper feeding direction. The paper loading plate 50 has a paper loading surface (corresponding to a recording medium loading surface) 50*c* on which the paper P is loaded. The paper loading surface 50*c* has an opening 50*d* into which the adjustment pin 55 is inserted.

Figure 4:
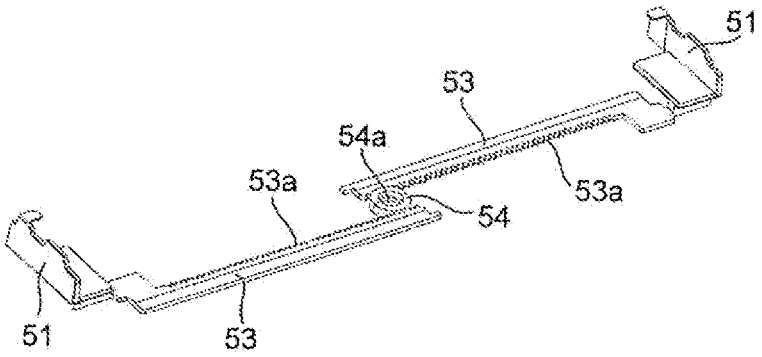
FIG. 4 is a perspective view illustrating the configurations of widthwise positioning members, racks and a pinion of the stack tray of the embodiment.

The pair of the widthwise positioning members 51 are provided on the paper loading plate 50 for positioning paper P in the widthwise direction perpendicular to the paper feeding direction. As illustrated in FIG. 4, the pair of racks 53 are respectively provided on the pair of widthwise positioning members 51. The pair of racks 53 extend along the widthwise direction perpendicular to the paper feeding direction. The pair of racks 53 are configured to move in the widthwise direction integrally with the pair of widthwise positioning members 51.

The pinion 54 is rotatably provided on the main body 52. The pinion 54 is engaged with each of the racks 53. The pinion 54 has, on its outer circumferential surface, a pinion gear (not shown) formed to be engaged with rack gears 53*a* of the racks 53. Accordingly, the pinion 54 is rotated in association with the movement of the racks 53. As a result, when one of the widthwise positioning members 51 is moved, the pinion 54 is rotated, and the other of the widthwise positioning members 51 is moved in the opposite direction to the former widthwise positioning member 51 by the same distance.

Figure 5:
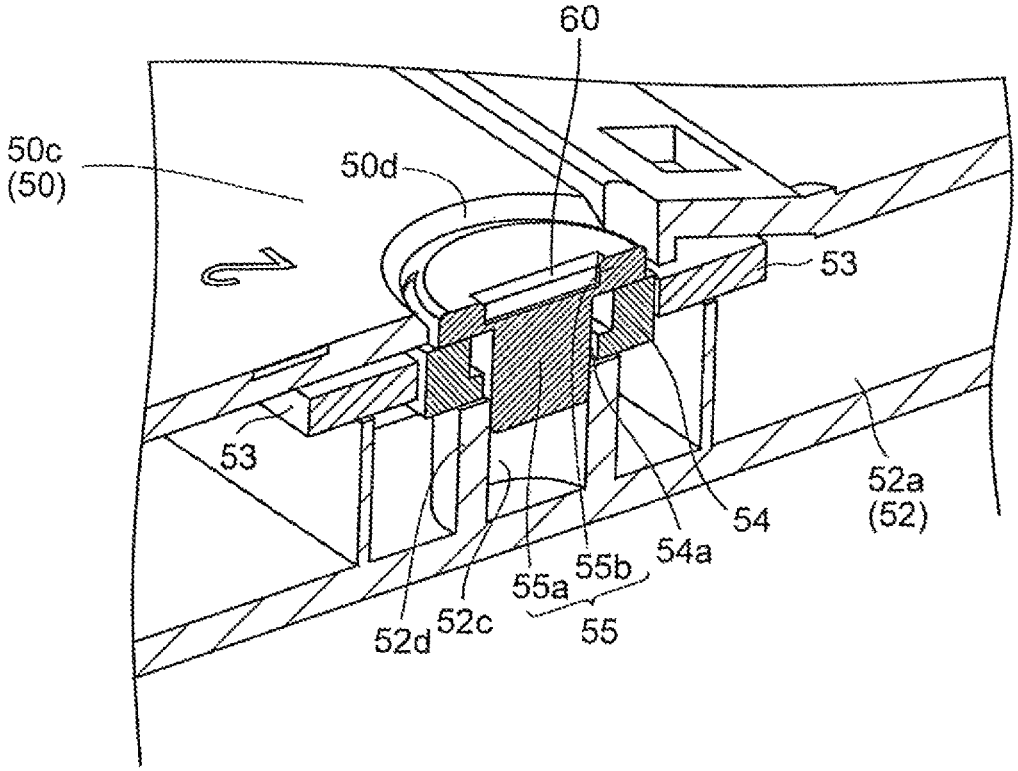
FIG. 5 is an enlarged cross-sectional perspective view illustrating the configuration around an adjustment pin of the stack tray of the embodiment.

The adjustment pin 55 adjusts the rotation load of the pinion 54. As illustrated in FIG. 5, the adjustment pin 55 includes a shaft 55*a* and a head 55*b* formed at one end of the shaft 55*a*. Specifically, the shaft 55*a* includes a thread portion on which a thread ridge (not shown) is formed and a cylindrical portion on which no thread ridge is formed. The head 55*b* is formed at one end of the shaft 55*a* on the side of the cylindrical portion. The head 55*b* has a diameter larger than the shaft 55*a*. The adjustment pin 55 is inserted into an insertion hole 54*a* formed at the center of the pinion 54. In other words, the adjustment pin 55 is provided coaxially with the pinion 54 and works also as the rotating shaft of the pinion 54. That is the adjustment pin 55 forms the rotating shaft of the pinion 54. The adjustment pin 55 as the rotating shaft protrudes on the paper loading plate 50 and rotatably supports the pinion 54. It is noted that although the adjustment pin 55 works as the rotating shaft of the pinion 54 in the present embodiment, another member may be provided as the rotating shaft.

Besides, a screw portion 52*d* having a threaded hole 52*c* is formed in the bottom plate 52*a* of the main body 52. The screw portion 52*d* in the present embodiment is a boss. The screw portion 52*d* protrudes 52 toward the paper loading plate 50 from the main body. The threaded hole 52*c* has a thread groove (not shown) to be engaged with the thread ridge of the shaft 55*a*. The shaft 55*a* of the adjustment pin 55 is fit in the threaded hole 52*c* of the screw portion 52*d*. The pinion 54 is sandwiched between the head 55*b* of the adjustment pin 55 and the screw portion 52*d*. The adjustment pin 5 rotatably attaches the pinion 54 to the screw portion 52*d*. Besides, the top surface of the head 55*b* of the adjustment pin 55 is exposed on the opening 50*d* of the paper loading plate 50. In addition, in the top surface of the head 55*b*, a groove (operating groove) 60 for catching a jig for rotating the shaft 55*a* (such as a coin or a flathead screwdriver) is formed. The groove 60 is in a shape of a linear grove in the present embodiment. Hereinafter, the groove 60 is designated as the linear groove 60.

The adjustment pin 55 applies the rotation load to the pinion 54 by allowing the pinion 54 to be in contact therewith. Specifically, by rotating the adjustment pin 55 around an axis extending in the thickness direction of the paper loading plate 50, the thread ridge formed in the shaft 55*a* of the adjustment pin 55 is engaged with a thread groove (not shown) formed on the inner surface of the screw portion 52*d*, so that the adjustment pin 55 can move in the thickness direction of the paper loading plate 50. Accordingly, the frictional resistance of the pinion 54 caused by the head 55*b* of the adjustment pin 55 and the screw portion 52*d* is changed. As a result, the rotation load of the pinion 54 is changed. In other words, the adjustment pin 55 is capable of adjusting the rotation load of the pinion 54 in a manner to move in the thickness direction of the paper loading plate 50.

Figure 6:
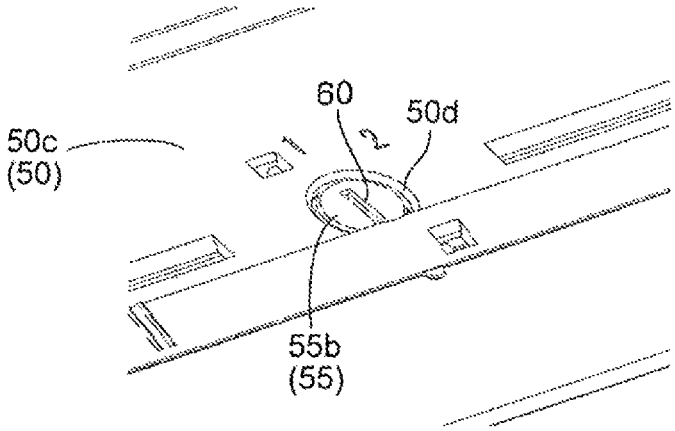
FIG. 6 is a perspective view illustrating the configuration around the adjustment pin of the stack tray of the embodiment.
Figure 7:
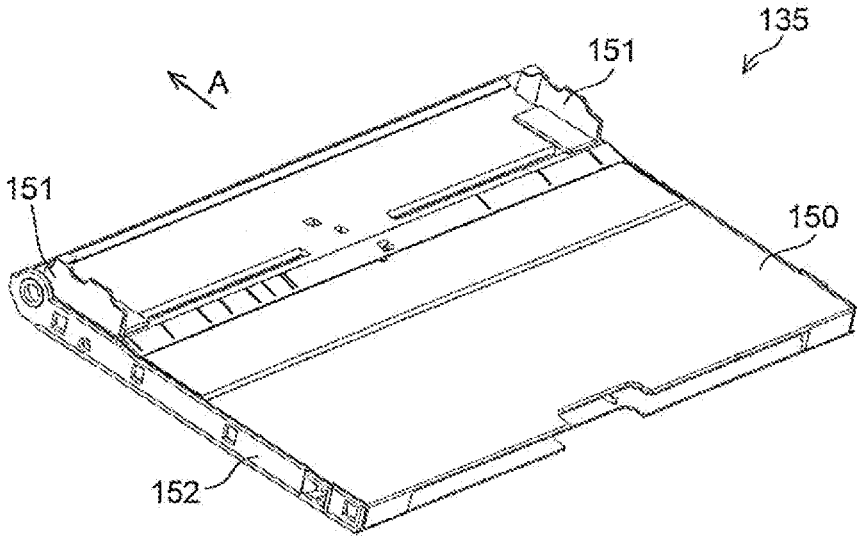
FIG. 7 is a perspective view illustrating the configuration of an exemplary general stack tray.
Figure 8:
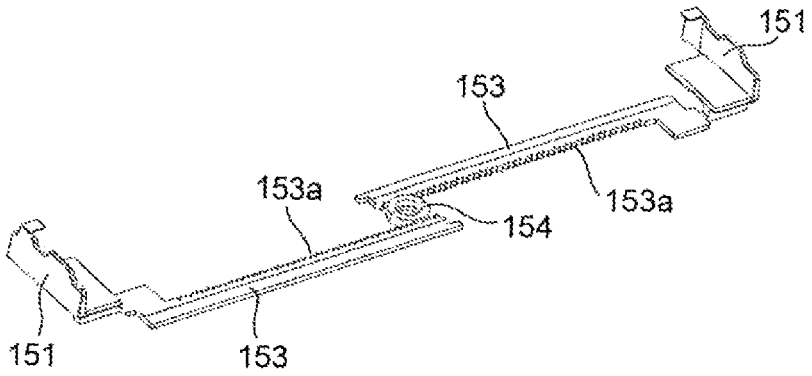
FIG. 8 is a perspective view illustrating the configurations of widthwise positioning members, racks and a pinion of the general stack tray.
Figure 9:
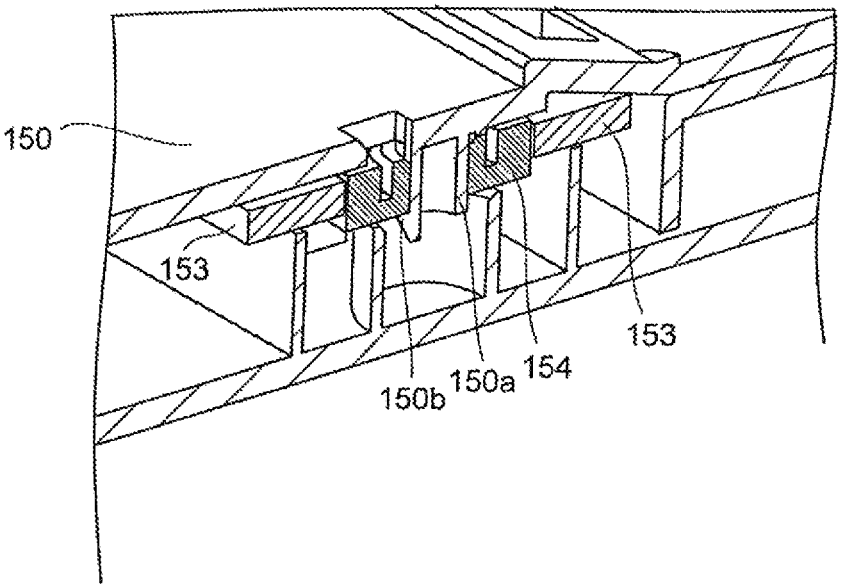
FIG. 9 is an enlarged cross-sectional perspective view illustrating the configuration around the pinion of the general stack tray.

In the present embodiment, for example, marks (scales) corresponding to the level of the rotation load of the pinion 54, such as "1" and "2", are formed around the opening 50*d* of the paper loading surface 50*c* as illustrated in FIG. 6. The rotation load of the pinion 54 can be adjusted by setting the linear groove 60 of the adjustment pin 55 to face either of the marks. Accordingly, a user can easily set the rotation load of the pinion 54 by using the adjustment pin 55.

If plain paper is to be fed, for example, the rotation load of the pinion 54 can be reduced by rotating the adjustment pin 55 to set the linear groove 60 of the adjustment pin 55 to face the mark "1". As a result, the operability of the widthwise positioning members 51 can be improved. On the other hand, if thick paper is to be fed, for example, the rotation load of the pinion 54 can be increased by rotating the adjustment pin 55 to set the linear groove 60 to face the mark "2". As a result, the skew of the thick paper can be suppressed by restraining the movement of the widthwise positioning members 51.

Incidentally, for regulating the rotation range of the adjustment pin 55, a regulation portion can be provided on the adjustment pin 55 and/or the paper loading plate 50.

As described with reference to FIGS. 2 to 6 so far, the adjustment pin 55 is provided in the present embodiment. The adjustment pin 55 is rotated around the axis extending in the thickness direction of the paper loading plate 50 to move in the thickness direction of the paper loading plate 50 for adjusting the rotation load of the pinion 54. In other words, the rotation load of the pinion 54 can be adjusted by rotating the adjustment pin 55. The adjustment pin 55 is rotated, for example, in accordance with the type of paper P, so as to adjust the rotation load of the pinion 54. Accordingly, the rotation load of the pinion 54 can be properly adjusted in accordance with the type of paper P.

For example, if plain paper having a small load on the widthwise positioning members 51 in paper feeding is to be fed, the rotation load of the pinion 54 is reduced, so that degradation of the operability of the widthwise positioning members 51 can be suppressed. On the other hand, if thick paper is to be fed, for example, the rotation load of the pinion 54 can be increased to restrain the movement of the widthwise positioning members 51, so as to suppress the skew of the thick paper. In this manner, when the moving load of the widthwise positioning members 51 is adjusted by adjusting the rotation load of the pinion 54, satisfactory operability of the widthwise positioning members 51 and the effect to suppress the skew of paper P can be both attained.

Besides, as described above with reference to FIG. 5, the adjustment pin 55 also works as the rotating shaft of the pinion 54 in the present embodiment. As a result, the configuration around the adjustment pin 55 and the pinion 54 can be simplified.

Furthermore, the screw portion 52*d* having the threaded hole 52*c* for inserting the shaft 55*a* of the adjustment pin 55 is formed in the main body 52. The pinion 54 is rotatably supported on the cylindrical portion of the adjustment pin 55 and sandwiched between the seat surface of the head 55*b* of the adjustment pin 55 and the end surface of the screw portion 52*d*, and the rotation load of the pinion 54 is adjusted by the screw force of the adjustment pin 55. Accordingly, the rotation load of the pinion 54 can be easily adjusted by rotating the adjustment pin 55. Besides, the pinion 54 can be uniformly sandwiched by the head 55*b* of the adjustment pin 55 and the screw portion 52*d* along the peripheral direction of the pinion 54. As a result, unsymmetrical contact of the head 55*b* of the adjustment pin 55 to the pinion 54 can be suppressed.

Moreover, the linear groove 60 is formed on the top surface of the head 55*b* of the adjustment pin 55. Accordingly, the adjustment pin 55 can be easily rotated by using a coin or a flathead screwdriver.

As described with reference to FIG. 6, the top surface of the adjustment pin 55 is exposed on the opening 50*d*. Accordingly, the adjustment pin 55 can be easily rotated. As a result, the rotation load of the pinion 54 can be easily adjusted.

Incidentally, the embodiment described herein is intended to be illustrative and not restrictive. The scope of the present disclosure is defined not by the description of the embodiment but by the appended claims, and embraces all modifications as fall within the scope of the claims, together with all equivalents thereof.

For example, although the stack tray (manual feed tray) is described in the above embodiment as an example of the recording medium feeding unit of the present disclosure, the present disclosure is not limited to the stack tray. The present disclosure is applicable also to, for example, a paper feed cassette (corresponding to a recording medium feeding unit) attachable/detachable to/from the main body of an image forming apparatus and having a paper loading plate fluctuated in the vertical direction. Besides, the present disclosure is applicable also to a paper feeding unit (i.e., a recording medium feeding unit) for an automatic document feeder provided in an upper portion of the main body of an image forming apparatus for automatically feeding an original document to a document placing glass table to read an image.

Besides, the rotation load of the pinion is adjusted in two levels in the above-described embodiment, which does not limit the present disclosure, but the rotation load of the pinion can be adjusted in three or more levels. In such a case, the rotation load of the pinion can be suitably adjusted in accordance with three or more kinds of paper P (such as plain paper, a postcard, and thick paper thicker than a postcard).

Furthermore, although the adjustment pin is provided coaxially with the pinion in the above-described embodiment, the adjustment pin may not be provided coaxially with the pinion.

What is claimed is:

1. A recording medium feeding unit, comprising:

a recording medium loading plate configured to load a recording medium;

a main body configured to hold the recording medium loading plate;

a pair of positioning members configured to position the recording medium in a widthwise direction perpendicular to a conveyance direction for the recording medium;

a pair of racks respectively provided on the pair of positioning members, extending along the widthwise direction, and configured to move in the widthwise direction integrally with the pair of positioning members;

a pinion rotatably provided on the main body and configured to be engaged with each of the racks and to rotate in association with movement of the racks; and a boss protruding toward the recording medium loading plate from the main body; and an adjustment pin protruding on the recording medium loading plate, inserted in an insertion hole formed at a center of the pinion, and configured to rotatably attach the pinion to the boss, wherein the adjustment pin applies a rotation load to the pinion by allowing the pinion to be in contact therewith, and is capable of adjusting the rotation load of the pinion in a manner to move in a thickness direction of the recording medium loading plate.

2. A recording medium feeding unit according to claim 1, wherein the adjustment pin includes:

a shaft having a thread portion on which a thread ridge is formed and a cylindrical portion on which no thread ridge is formed; and a head formed at one end of the shaft on a side of the cylindrical portion, the head having a diameter larger than a diameter of the shaft, the boss has a threaded hole having a thread groove to be engaged with the thread ridge of the shaft, and the pinion is rotatably supported on the cylindrical portion of the adjustment pin and is sandwiched between a seat surface of the head and an end surface of the boss, and the rotation load of the pinion being adjusted by a screw force of the adjustment pin.

3. A recording medium feeding unit according to claim 2, wherein an operating groove for rotating the shaft is formed on a top surface of the head of the adjustment pin.

4. A recording medium feeding unit according to claim 3, wherein an opening for inserting the adjustment pin is formed on the recording medium loading plate, and the top surface of the head of the adjustment pin is exposed on the opening of the recording medium loading plate.

5. A recording medium feeding unit according to claim 4, wherein a scale corresponding to a level of the rotation load is formed around the opening of the recording medium loading plate, and the rotation load is adjustable by setting the operating groove of the adjustment pin to face the scale.

6. A recording medium feeding unit according to claim 1, wherein the rotation load of the pinion is adjustable in three or more levels.

7. A recording medium feeding unit according to claim 1, wherein the adjustment pin is rotated for adjusting the rotation load of the pinion in accordance with a type of the recording medium.

8. An image forming apparatus, comprising:

a recording medium feeding unit according to claim 1; and an image forming section configured to form an image on a recording medium fed from the recording medium feeding unit.

9. An image forming apparatus according to claim 8, wherein the adjustment pin includes:

a shaft having a thread portion on which a thread ridge is formed and a cylindrical portion on which no thread ridge is formed; and a head formed at one end of the shaft on a side of the cylindrical portion and having a diameter larger than a diameter of the shaft, a threaded hole having a thread groove to be engaged with the thread ridge of the shaft is formed in the boss, and the pinion is rotatably supported on the cylindrical portion of the adjustment pin and is sandwiched between a seat surface of the head and an end surface of the screw portion, the rotation load of the pinion being adjusted by a screw force of the adjustment pin.

10. An image forming apparatus according to claim 9, wherein an operating groove for catching a jig for rotating the shaft is formed on a top surface of the head of the adjustment pin.

11. An image forming apparatus according to claim 10, wherein an opening for inserting the adjustment pin is formed in the recording medium loading plate, and the top surface of the head of the adjustment pin is exposed on the opening of the recording medium loading plate.

12. An image forming apparatus according to claim 11, wherein a scale corresponding to a level of the rotation load is formed around the opening of the recording medium loading plate, and the rotation load is adjustable by setting the operating groove of the adjustment pin to face the scale.

13. An image forming apparatus according to claim 8, wherein the rotation load of the pinion is adjustable in three or more levels.

14. An image forming apparatus according to claim 8, wherein the adjustment pin is rotated for adjusting the rotation load of the pinion in accordance with a type of the recording medium.

* * * * *